United States Patent [19]

Hunter et al.

[11] Patent Number: 4,486,927

[45] Date of Patent: Dec. 11, 1984

[54] PRODUCTION OF EXPANDED METAL PARTS

[75] Inventors: Richard H. Hunter; Karl Heins, both of New South Wales, Australia

[73] Assignee: Rondo Building Services Pty. Limited, New South Wales, Australia

[21] Appl. No.: 494,627

[22] Filed: May 16, 1983

[30] Foreign Application Priority Data

May 19, 1982 [AU] Australia ..... PF4070

[51] Int. Cl.[3] ..... B21D 31/04

[52] U.S. Cl. ..... 29/6.1

[58] Field of Search ..... 29/6.1

[56] References Cited

U.S. PATENT DOCUMENTS

| | | | |
|---|---|---|---|
| 3,897,705 | 8/1975 | Filleau et al. | 29/6.1 |
| 4,291,443 | 9/1981 | Laurie et al. | 29/6.1 |
| 4,305,187 | 12/1981 | Iwamura et al. | 29/6.1 |

*Primary Examiner*—Howard N. Goldberg
*Assistant Examiner*—Steven E. Nichols
*Attorney, Agent, or Firm*—Ladas & Parry

[57] ABSTRACT

Roll-forming method for perforated and expanded metal strips in which marginal edges of a strip of metal are perforated and engaged by a conveyor to advance the strip, a central web portion of the strip is slotted then expanded out of the plane of the marginal edges by a series of pressure rollers, and the strip then cut to desired length.

6 Claims, 5 Drawing Figures

7
8A
8B
9
10
5
16
12A
12B
A
B
C
24
33
32A
32B
32C
32
25
26
27
28
29
35A
35B
42
43
45
11
19
20
21
22
23
34
41
6

PRODUCTION OF EXPANDED METAL PARTS

This invention relates to the production of perforated metal strips.

BACKGROUND ART

There are many applications for such products, such as protective beadings for plastered internal and external corners of rooms, archways, expansion joints and decorative and structural components. Perforations are usually provided for purposes of light-weight, aesthetic appeal and/or permeation of glues, plaster or the like. Their present production entails an intermittent stamping operation for the provision of a perforated web, or webs, in the component and consequently there is wastage and also the speed of production is curtailed. Furthermore, as many beadings are of angle form and flanged, and therefore ideally suited for a roll-forming technique, their production is complicated and slow due to the need for rendering compatible intermittent stamping and continuous roll-forming.

DISCLOSURE OF INVENTION

It is the main object of the invention to achieve improved production of perforated metal strips.

To this end the invention, in one general form, provides a method of producing expanded metal components by roll-forming a metal strip (5), comprising continuously advancing said strip past cutting knives (12A, 12B) to provide parallel lines of longitudinal perforating slits (19) in a web portion (20 or 21) bounded by opposite lateral marginal portions (22 or 23), perforating said marginal portions at longitudinally spaced intervals and engaging projecting teeth (29) on a chain conveyor (25) with the perforations in each of said marginal portions during passage of said strip through an expansion station (24), progressively by a series by rollers (32A–C) forcing said web out of the plane of said marginal portions to effect expansion of said web as said strip is continuously passed through said station, and cutting the expanded strip to a desired length to form the expanded metal component.

In accordance with the invention there is also provided apparatus for producing expanded metal components by roll-forming a metal strip, comprising groups of roll-forming rollers supported in a line in the path of metal strip material passing from a bulk supply (6) to a cutting station (42), successively in said line a first pair of rollers (8A, 8B) having matching profiles (9, 10) to form a central bead (11) on the strip, two coacting sets of cutting knives (12A, 12B) cutting longitudinal slits (19) in a central web portion (20, 21) of the strip, a pair of driven conveyors at opposite sides of the web portion and each having a chain (25) with punching teeth (29) to perforate at intervals marginal portions (22, 23) on the strip and to engage therein to draw said strip along said path, a series of pressure rollers (32A–32C) between the conveyors to force said web out of the plane of said marginal portions, and a severing knife (42) at said cutting station to cut said strip into required lengths.

BRIEF DESCRIPTION OF DRAWINGS

A preferred embodiment will now be described with reference to the accompanying drawings, in which:

For the purpose of illustration it will be assumed that in the preferred embodiment herein described the metal component being produced is an equal angle external bead for a plastered corner of a room. According to present production methods a length of beading for this purpose is firstly passed through stamping machinery which intermittently punches apertures to form parallel webs equally spaced from the centre line of the metal strip. Subsequently, the beading is passed through roll-forming machinery to provide an arcuate bead along the centre line and to fold the flat metal strip to equal angle shape. Production speed of such beading is presently approximately 15 to 18 meters per minute while with the production method hereafter described production speeds in the vicinity of 150 meters per minute have been attained, the principal limitation being imposed by the final stage which effects cutting to length of the formed strip. With reference to FIGS. 1A and 1B, flat metal strip 5 is supplied from a stock roll 6 and enters the roll-forming machinery 7 between a first pair of rollers 8A and 8B in which roller 8A has a medial peripheral rib 9 locating at the nip between the rollers 8A and 8B within an annular groove 10 on roller 8B. As a result a medial longitudinally extending groove 11 generally of semicircular cross-section is impressed into the metal strip 5. As will become clear hereafter, groove 11 subsequently becomes the conventional corner bead.

Figure 2:
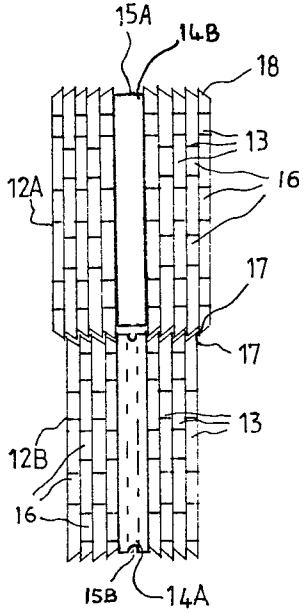
FIG. 2 is a detail as viewed on the section line A—A of FIG. 1A.

The strip 5 is passed continuously through the machinery 7 and enters the nip between two batteries 12A and 12B of cutting knives. As can be seen more clearly in FIG. 2 each battery 12A and 12B of knives consists of a stack of disk-shaped cutting blades 13 clamped to either side of a centrally disposed cylindrical plate 14. One of these plates 14A has a flat periphery 15A while the other plate 14B carries an annular groove 15B to register with the underside of the groove 11 in the strip 5 in its passage between the battery of knives 12A and 12B. Each knife 13 in one battery 12A forms a pair with a corresponding knife 13 in the other battery 12B. The periphery of each knife 13 is provided with a series of gaps 16 and has sharpened edges 17 between the gaps 16 which are formed by the provision of chamfers 18. The cutting knives 13 of each pair are positioned in spaced planes with their cutting edges 17 slightly overlapping and their chamfers 18 non-confronting. The gaps 16 correspond in position with each pair of knives 13, so that they fall into register with rotation of the batteries 12A and 12B, but the gaps 16 in all of the pairs of knives 13 are alternately staggered as viewed across the periphery of the batteries 12A and 12B. Thus, the disposition of the knives 13 and gaps 16 are such as to create parallel lines of longitudinal perforating slits 19 in two longitudinally extending bands to opposite sides of the groove 11. These bands of slits 19 form perforated webs 20 and 21 in the metal strip 5 and terminate short of the longitudinal edge of the strip 5 to create lateral marginal portions 22 and 23 which border the webs 20 and 21.

Figure 3:
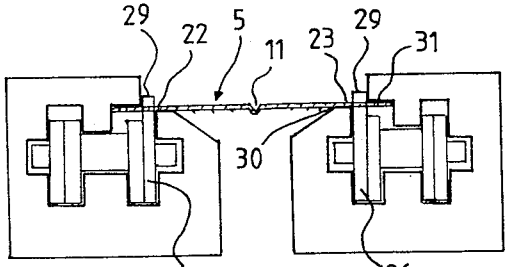
FIG. 3 is a detail as viewed on the section line B—B of FIG. 1A.

The next operation performed by the machinery 7 occurs at the entry point to an expansion stage 24. A chain conveyor 25 travels around sprockets 26 and 27 and it will be noted that each link 28 in the chain 25 is provided with a protruding prong 29. As can be seen more clearly in FIG. 3 the marginal portions 22 and 23 are supported between a bed 30 and an upper runner 31 while the prongs 29 in the upper run of the conveyor 25 extend above the bed 30. As a result the prongs 29 pierce the marginal portions 22 and 23 at intervals along the length of the strip 5, forming punched-out tabs 41, so that drive imparted to the sprockets 26 and 27 draws the metal strip 5 through the expansion station 24. Furthermore, however, the marginal portions 22 and 23 are firmly secured by the prongs 29 and the bed 30 and runner 31 against any displacement from its intended path. A series of three, or more, expansion rollers 32A, B and C, with downward pressure adjustable by bolt heads 33 each have an intermediate peripheral rib 32 formed to match the medial groove 11 and all rollers 32A–C progressively depress the medial portion of the strip 5 to a predetermined degree and in so doing the web portions 20 and 21 are expanded so that the slits 19 become diamond-shaped apertures 34, which due to the chamfers 18 provided on the cutting knives 13 (FIG. 2) are inclined to the plane of the web with a consequent advantage in use of assisting in permeation of glues, plaster etc.

Figures 1A, 1B:
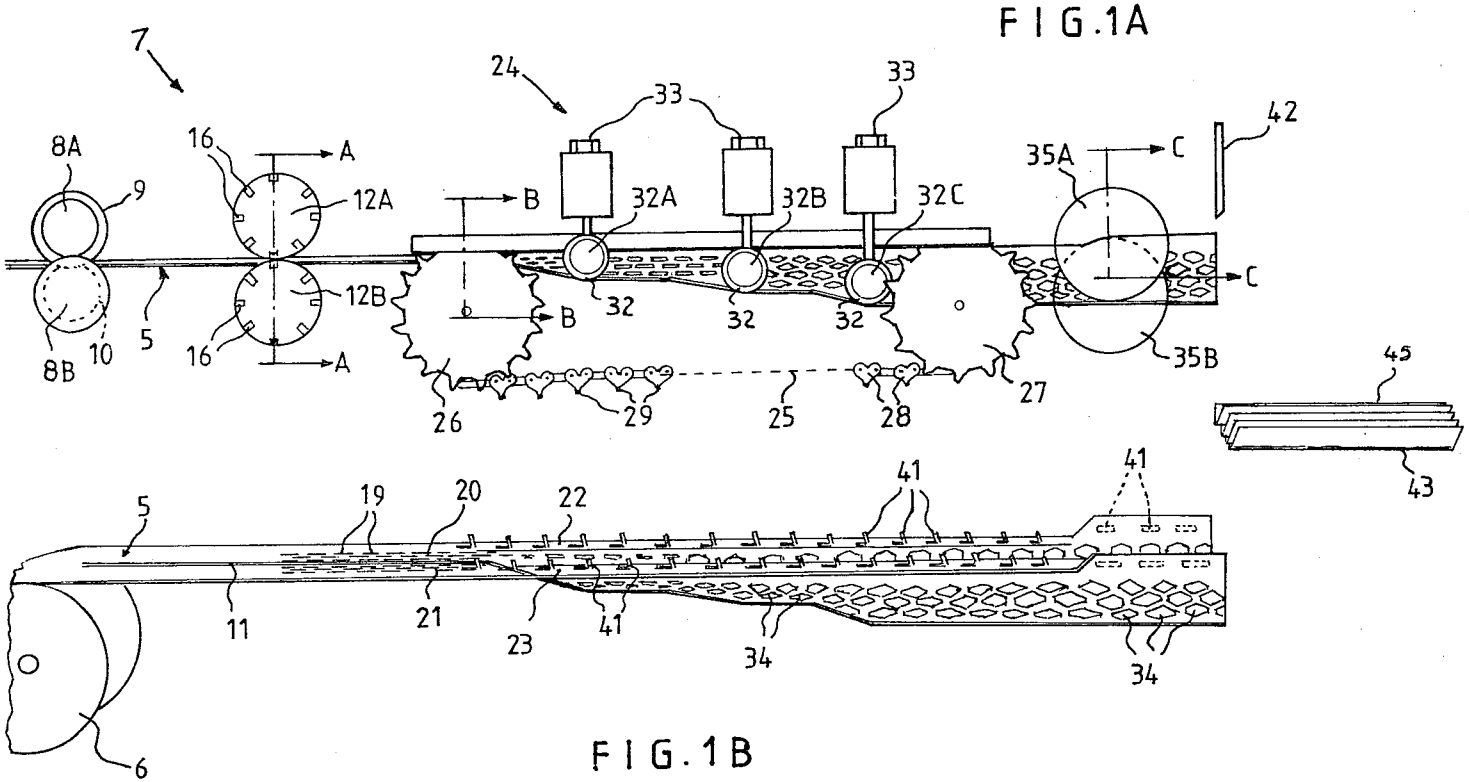
FIG. 1A depicts the passage of metal strip through machinery operating in accordance with the production method of this invention.
FIG. 1B shows the progressive changes occurring in the strip, which is shown to an enlarged scale, during the various operations performed by the machinery of FIG. 1A.
Figure 4:
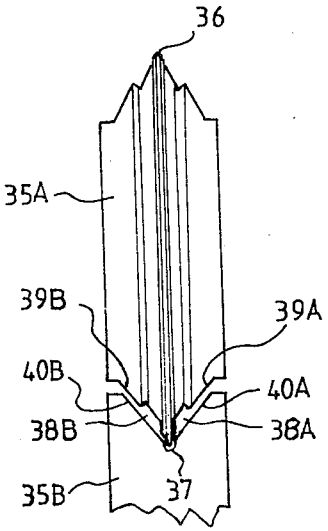
FIG. 4 is a detail as viewed on the section line C—C of FIG. 1A.

Due to the requirement for the marginal portions 22 and 23 to be coplanar with their respective webs in the present product, the expanded strip 5 is then passed between a final pair of rollers 35A and 35B which as shown in FIG. 4 are matchingly profiled in such a manner than the groove 11 of the strip 5 is located between the peripheral rib 36 on the roller 35A and the arcuate impression 37 in the roller 35B. Similar recesses 38A and 38B are disposed in the periphery of the roller 35A either side of the medial rib 36 to provide pockets to accommodate the webs 20 and 21, respectively. The shoulders 39A and 39B on roller 35A co-operate with the plain V-shaped walls 40A and 40B of the roller 35B to bend the marginal portions 22 and 23 into alignment with the webs 20 and 21 while simultaneously impressing the tabs 41 back into the plane of the marginal portions 22 and 23 from which they were punched out by the spikes 29 on the chain conveyor 25. The final form of expanded metal strip 5 is shown at the right hand end of FIG. 1B where it will be noted that the tabs 41 are barely discernible. The machinery 7 will be connected with a conventional parting device which will comprise a cutting knife 42 functioning to sever to a desired length the finished components 43.

Whereas a preferred embodiment has been described in the foregoing passages it should be understood that other forms, refinements and modifications are feasible within the scope of this invention. It will also be obvious that components of many different cross-sections may be produced according to the production method hereinbefore described by adopting well-known roll-forming techniques. It has also been found that an ideal archway bead can be obtained merely by removing from one flange of the corner bead described above one of the marginal portions 22 or 23 and some of its associated web 20 or 21. This is readily facilitated by the use of a guillotine, and it will be found that curvature of the resulting bead can then be performed by hand.

What we claim is:

1. A method of producing expanded metal components by rolling-forming a metal strip, comprising continuously advancing said strip past cutting knives to provide parallel lines of longitudinal perforating slits in a web portion bounded by opposite lateral marginal portions, perforating said marginal portions at longitudinally spaced intervals and engaging projecting teeth on a chain conveyor with the perforations in each of said marginal portions during passage of said strip through an expansion station, progressively by a series by rollers forcing said web out of the plane of said marginal portions to effect expansion of said web as said strip is continuously passed through said station, and cutting the expanded strip to a desired length to form the expanded metal component.

2. The method as claimed in claim 1, wherein a substantially medial longitudinally extending bead is rolled into the web portion by rollers before perforation of said marginal portions, and the plane of said marginal portions is substantially horizontal and said web is expanded by a downward force applied by each of the rollers in said series at a lower level than the preceding roller in said series.

3. The method as claimed in claim 2, wherein simultaneously with expansion of said web the web is bent along its longitudinal centre line to right-angle form by the engagement with said bead of the rollers of said series.

4. The method as claimed in claim 2, wherein before cutting of the expanded metal component each of said marginal portions is bent to conform to the plane of the adjacent part of said web portion.

5. Apparatus for producing expanded metal components by roll-forming a metal strip, comprising groups of roll-forming rollers supported in a line in the path of metal strip material passing from a bulk supply to a cutting station, successively in said line a first pair of rollers having matching profiles to form a central bead on the strip, two coacting sets of cutting knives cutting longitudinal slits in a central web portion of the strip, a pair of driven conveyors at opposite sides of the web portion and each having a chain with punching teeth to perforate at intervals marginal portions on the strip and to engage therein to draw said strip along said path, a series of pressure rollers between the conveyors to force said web out of the plane of said marginal portions, and a severing knife at said cutting station to cut said strip into required lengths.

6. Apparatus as claimed in claim 5, wherein said series of pressure rollers are in line and engage said strip at progressively greater distances from the plane of said marginal portions, and each has a peripheral rib for engaging said bead on the strip whereby the web is simultaneously expanded and bent to a right angle.

* * * * *